US006557612B2

(12) United States Patent
Voss

(10) Patent No.: US 6,557,612 B2
(45) Date of Patent: May 6, 2003

(54) ARTICULATED ARM FOR AN AWNING

(75) Inventor: Wolfgang Voss, Attendorn (DE)

(73) Assignee: Paul Voss GmbH & Co. KG, Finnentrop-Heggen (DE)

( * ) Notice: Subject to any disclaimer, the term of this patent is extended or adjusted under 35 U.S.C. 154(b) by 0 days.

(21) Appl. No.: 09/887,311

(22) Filed: Jun. 22, 2001

(65) Prior Publication Data

US 2002/0069976 A1 Jun. 13, 2002

Related U.S. Application Data

(63) Continuation of application No. PCT/EP99/08436, filed on Nov. 4, 1999.

(30) Foreign Application Priority Data

Dec. 23, 1998 (DE) ..... 198 59 731

(51) Int. Cl.[7] ..... E04F 10/00
(52) U.S. Cl. ..... 160/79; 160/70
(58) Field of Search ..... 160/70, 79; 248/160, 248/330.1, 292.13, 273, 281.11, 28.11; 135/88.1, 88.11, 88.12

(56) References Cited

FOREIGN PATENT DOCUMENTS

| | | | |
|---|---|---|---|
| DE | 7724077 | | 8/1978 |
| DE | 90 03 068.0 | | 8/1990 |
| EP | 0 489 186 | A1 | 6/1992 |
| FR | 2 762 633 | A1 | 10/1998 |
| NL | 6704769 | * | 4/1967 |
| NL | A 9400820 | | 1/1996 |

* cited by examiner

*Primary Examiner*—Blair M. Johnson
(74) *Attorney, Agent, or Firm*—Knobbe, Martens, Olson & Bear, LLP.

(57) ABSTRACT

An articulated arm for an awning such as for a patio or deck including at least first and second arm parts joined by an articulation. Longitudinal axes of the arm parts are orthogonal to the articulation axis. The articulated arm also includes at least two springs arranged adjacent each other and first ends of the springs are fixed to the first arm part. At least two traction elements are also and are individually connected to second ends of the springs. The traction elements are led via the articulation to the second arm part and are fixed thereto. The traction elements are wire cables which include a plastic coat in at least a region adjacent the articulation.

10 Claims, 2 Drawing Sheets

ARTICULATED ARM FOR AN AWNING

CROSS REFERENCE TO PENDING APPLICATION

This is a continuation of pending International application PCT/EP99/08436 filed on Nov. 4, 1999, which designates the United States and claims priority of German patent application DE 198 59 731 filed on Dec. 23, 1998.

BACKGROUND OF THE INVENTION

1. Field of the Invention

The present invention relates to an articulated arm for an awning, comprising a first arm part and at least a second arm part, wherein the first arm part and the second arm part are connected with each other via an articulation, the articulation axis of which runs transversely to the longitudinal axis of the arm parts, and wherein, in the first arm part, at least two springs adjacent to each other are arranged, with one end of the springs being fixed on the first arm part, and on the other end of the springs at least one flexible traction element is fixed which is led via the articulation into the second arm part, where it is fixed on the second arm part.

2. Description of the Related Art

One type of articulated arm is generally known from European patent number EP 0 489 186 A1. The articulated arm mentioned is used in a certain type of awnings, in so-called articulated arm or folding-arm awnings. Such awnings have an awning fabric, which is held upon a fabric winding spindle in such a way that it can be wound up and wound off. A forward end of the awning fabric is fixed on an extension bar, which is moved away from the fabric winding spindle, if the awning fabric is wound off the fabric winding spindle, and which is moved towards the same when the awning fabric is wound up. The extension bar on which the forward end of the awning fabric is fixed is, at the same time, over the at least one, usually two articulated arms, connected to a supporting part of the awning, e.g. a support tube.

Such an articulated arm typically has at least two arm parts which are connected with each other via an articulation, the axis of which runs transversely to the longitudinal axis of the arm parts. One arm part, which is generally designated as the upper arm is, at the same time, connected in an articulated way with its end facing away from the articulation to the supporting part of the awning, i.e. the support tube. The other arm part, which is generally designated as the forearm is, with its end facing away from the articulation, connected to the extension bar in an articulated way.

When the awning is completely reeled in, wherein the awning fabric is completely wound up on the fabric winding spindle, the articulated arm is bent to its maximum, i.e. the first and the second arm part are nearly parallel and adjacent to each other and run approximately parallel with the extension bar and the support tube. When the awning is reeled out to its maximum extent, i.e. if the awning fabric is completely wound off the fabric winding spindle, the articulated arm is stretched.

The articulated arm or the articulated arms of the awning have the function to push away the extension bar, when the awning fabric is wound off the fabric winding spindle, in order to pull away the fabric under tension when it is wound off the fabric winding spindle. For that purpose, in one of the arm parts, e.g. in the upper arm of the articulated arm, at least one spring is arranged, the one end of which is fixed to the first arm part, and to the other end of which an end of at least one flexible traction element is fixed, e.g. in the shape of a wire cable or a chain, which is led over the articulation that connects the two arm parts into the second arm part, where it is fixed with its other end onto the second arm part.

When the awning is reeled in and the articulated arm is bent to its maximum, the spring, which is usually designed as a tension spring, is stretched to its maximum. When the articulated arm is bent, the distance length between the fixation point of the traction element on the forearm and the fixation point of the spring on the upper arm is, namely, enlarged by the curve length of the bent articulation. The spring is, thus, when the articulated arm is bent, stretched to its maximum, so that the bent articulated arm is pre-stretched in its stretched position, with the effect that the articulated arm, when the fabric is wound off, stretches on his own.

In order to pre-stretch the articulated arm even in an awning with a relatively high extension length correspondingly in its stretched position, high spring forces are often required. The springs used have, thus, a very high spring constant. In awnings with high extension length, moreover, at least two springs or even more springs are used, which are adjacently arranged in the one arm part.

In these articulated arms, the at least two springs are typically connected with each other, on their free end, by means of a brace, wherein one single suspension is arranged on the brace, e.g. in the shape of a hook, on which, then, one single traction element is commonly fastened. The traction element, thus, has to take up the force of two or more springs. The traction element is, correspondingly, much more stressed as if it was connected to only one spring. This may result in reduction of the endurance of the traction element, i.e. the durability under load of the traction element is reduced when the awning is reeled in and reeled out. The traction element is exposed to repeated alternating stress, in particular in the region of the articulation, where it experiences a deflection, so that the one traction element can tear earlier.

It has therefore been suggested to use, instead of one traction element, a string of several traction elements, which are tied together on their one end, which is connected to the end of the springs. In this way, however, again only one fixing point of all traction elements with all springs is created. In other words, again only a simple connection between the bunched end of the traction elements and the collected end of the springs exists, which, again, are exposed to higher stress. If this fixing point tears off during operating the awning, there is no connection anymore between the traction elements and the springs, and the function of the articulated arm is compromised. European patent EP 0 489 186 A1 discloses a similar articulated arm comprising two parallel chains as traction elements which are individually connected to the two springs, respectively.

Therefore, it is an object of the present invention to provide an improved articulated arm that can longer resist the repeated alternating stress when the awning is reeled in and out without suffering damage.

SUMMARY OF THE INVENTION

According to one aspect of the invention, this object is achieved by an articulated arm for an awning, comprising a first arm part and at least a second arm part each having a longitudinal axis, an articulation having an articulation axis, the first arm part and the second arm part being connected to each other via the articulation, and the articulation axis running transversely to the longitudinal axes of the arm parts, at least two springs arranged adjacent to each other and each of the springs having a first end and a second end, the first ends being fixed at the first arm part, at least two traction elements each having a first end and a second end, the first ends being individually connected to the second ends of the springs, and the traction elements being led via the articulation to the second arm part and fixed thereto, wherein at least one traction element is assigned to each spring and wherein the traction elements are wire cables, which comprise, at least in their region which is led via the articulation, a plastic coat.

In this aspect, instead of fixing one single traction element with its end together onto the at least two springs, or instead of bunching several traction elements on one end and then, bunched, connecting with all springs together, it is provided, according to the invention, to assign to each existing spring at least one separate traction element, which is, then, fixed only onto the spring that is assigned to it. Each traction element, therefore, has to take up the force of only one spring, which reduces the stress of each individual traction element. Further, instead of using chains as traction elements, the traction elements are wire cables having a plastic coat at least in the region of the articulation. The plastic coat advantageously reduces friction and wear of the wire cables in the region of the articulation. Durability under load tests have shown that the endurance of the articulated arm according to the invention in comparison with known articulated arms is by far higher even than the endurance of articulated arms using chains.

Another advantage of this embodiment of the articulated arm of the invention is that, should one traction element tear, the at least one further traction element and the at least one further spring are still connected, so that the function of the articulated arm is at least partly maintained, and that then the connection still existing of the remaining traction element with the remaining spring is exposed to no higher stress than if all traction element spring connections were intact. This object of the invention is in that way completely achieved.

In another aspect, the traction element assigned to the corresponding spring is fixed, with its second end, individually on the second arm part. By this measure, the operational safety of the articulated arm is increased even further, as in this embodiment both ends of the traction element are fixed individually both to the assigned spring and to the fixation point on the second arm. Alternatively, however, if the traction elements are bundled, on their end fixed on the second arm part to one end, and the bundled end is fixed on the second arm part, the collection or bundling of the ends fixed onto the second arm part, which are still fixed individually on each spring, has the advantage that the traction elements can more easily be fixed when the articulated arm is mounted, since, then, only one end has to be fixed onto the second arm part.

In a further aspect, the springs are coil springs and an insert nut is fixed on at least one end of these springs, respectively, into which a suspension eyelet is screwed. This configuration of the springs also contributes to higher endurances of the articulated arm. In usual articulated arms, namely, coil springs are generally used, the ends of which are formed into a hook. Forming of a coil spring end into a hook leads, however, to material weakening and earlier material fatigue of the springs in the region of the hook-shaped formed ends.

By fixing an insert nut onto at least one end of the springs, as it is provided according to this aspect of the invention, into which a suspension eyelet is screwed, a fixation point for the traction element or for the fixation of the spring on the first arm part is created, which eliminates the need for the spring being formed and, thus, from experiencing material fatigue. It is then preferred if the insert nuts are rolled or pressed into the spring. By this measure, a particularly tight connection that can resist high stress is created between the insert nut and the spring.

In yet another aspect, at least two traction elements are assigned to each spring. In this embodiment, the at least two traction elements are preferably, according to the invention, individually fixed onto the spring assigned to them. By assigning at least two traction elements per spring, the endurance of the articulated arm can be increased even further.

Further advantages can be taken from the description and the enclosed drawings. It is to be understood that the features mentioned above and those yet to be explained below can be used not only in the respective combinations indicated, but also in other combinations or in isolation, without leaving the scope of the present invention.

BRIEF DESCRIPTION OF THE DRAWINGS

An embodiment of the invention is shown in the drawings and will be explained in more detail in the description below. In the drawings.

DETAILED DESCRIPTION OF THE PREFERRED EMBODIMENT

Figure 1:
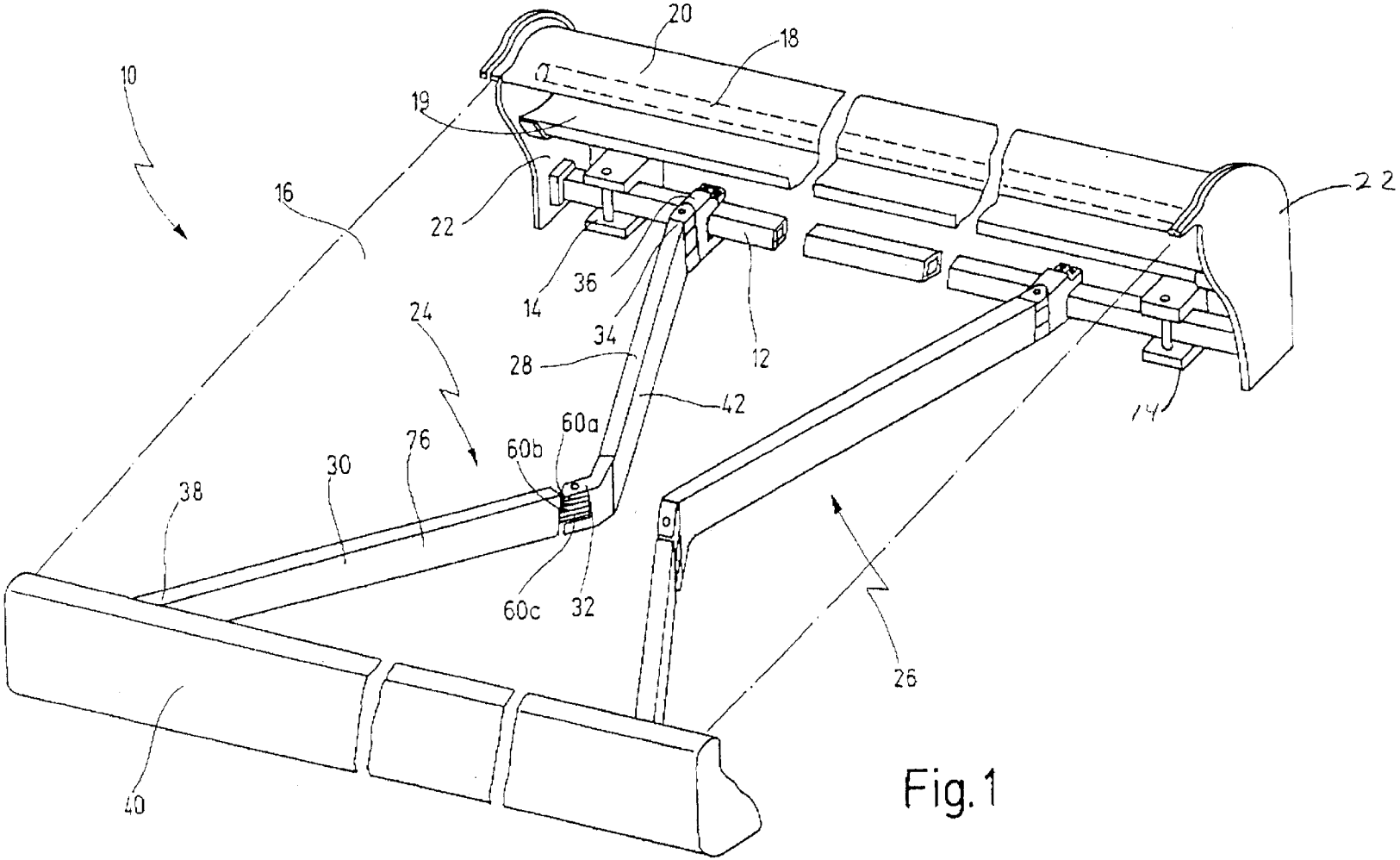
FIG. 1 shows a schematic perspective presentation in total of an awning.

Reference will now be made to the drawings wherein like numerals refer to like parts throughout. In FIG. 1, one embodiment of an awning designated with the general reference number 10 is shown, partly in a discontinuous way. Awning 10 is used for shading terraces and the like. Awning 10 has a support tube 12, which is used as supporting part of awning 10, and via which awning 10 is fixed by means of wall consoles 14 onto a building wall (not shown). Wall consoles 14 are, on one side, fixed onto the support tube 12 and have fixation portions for fixing on the building wall, which are not shown in detail but is performed in a manner well understood by one of ordinary skill in the art.

Awning 10 has further an awning fabric 16 (shown in ghost view if FIG. 1), which can be wound up and wound off of fabric winding spindle 18, which is represented with broken lines. For that purpose, fabric winding spindle 18 is in connection with a gear, which is not shown in detail, on one end of fabric winding spindle 18, which can be manually driven by a crank handle, or is alternatively driven via an electric motor. Fabric winding spindle 18 can be driven via the gear in two senses of rotation around its longitudinal axis.

Fabric winding spindle 18 is, except a front slot 19 running parallel to fabric winding spindle 18, surrounded about its circumference by a sleeve 20, which protects the fabric 16 being wound onto fabric winding spindle 18 from detrimental environmental influences. Sleeve 20 is retained, on both ends, by means of side parts 22 fixed onto support tube 12.

Awning 10 further has an articulated arm 24 and another articulated arm 26, articulated arm 26 and articulated arm 24 being designed, in this embodiment, identically to each other and being arranged substantially mirror-symmetrically to each other, so that in the following only articulated arm 24 will be further described. It should be understood that the description of a single articulated arm 24 that follows refers equally to multiple articulated arms 24, 26.

Articulated arm 24 has a first arm part 28, which is also designated as upper arm. Articulated arm 24 further has a second arm part 30, which is also designated as forearm. First arm part 28 and second arm part 30 are articulatedly connected with each other via an articulation 32, whereby a rotational axis of articulation 32 runs transversely to the longitudinal direction of first arm part 28 and/or to the longitudinal direction of second arm part 30.

First arm part 28 is connected, with its end 34 facing away from articulation 32, over a supporting trestle 36, with support tube 12. First arm part 28 is, therewith, articulatedly connected to supporting trestle 36. Second arm part 30 is connected, articulatedly, with its end 38 facing away from articulation 32 with an extension bar 40.

One function of articulated arm 24 and also of articulated arm 26 is to locate extension bar 40, and, when awning fabric 16 is wound off, to push extension bar 40 away from fabric winding spindle 18. When awning fabric 16 is completely wound up on fabric winding spindle 18, extension bar 40 rests closely adjacent slot 19 of sleeve 20. Articulated arm 24 and articulated arm 26 are then bent to their maximum extents, i.e. first arm part 28 and second arm part 30 extend approximately parallel to support tube 12, i.e. first arm part 28 and second arm part 30 are folded together around articulation 32. The same applies for articulated arm 26.

Proceeding from this state reeled-in to its maximum, awning fabric 16 can be wound off by turning fabric winding spindle 18, whereby articulated arms 24 and 26 have the function to push extension bar 40 away from fabric winding spindle 18 and to pull away awning fabric 16 wound off under stress from fabric winding spindle 18, so as to inhibit sag of the awning fabric 16. To fulfill this function, articulated arm 24 is prestressed from the maximally bent into the stretched position by adding spring force. This is described in the following with reference to FIGS. 2A and 2B.

Figure 2A:
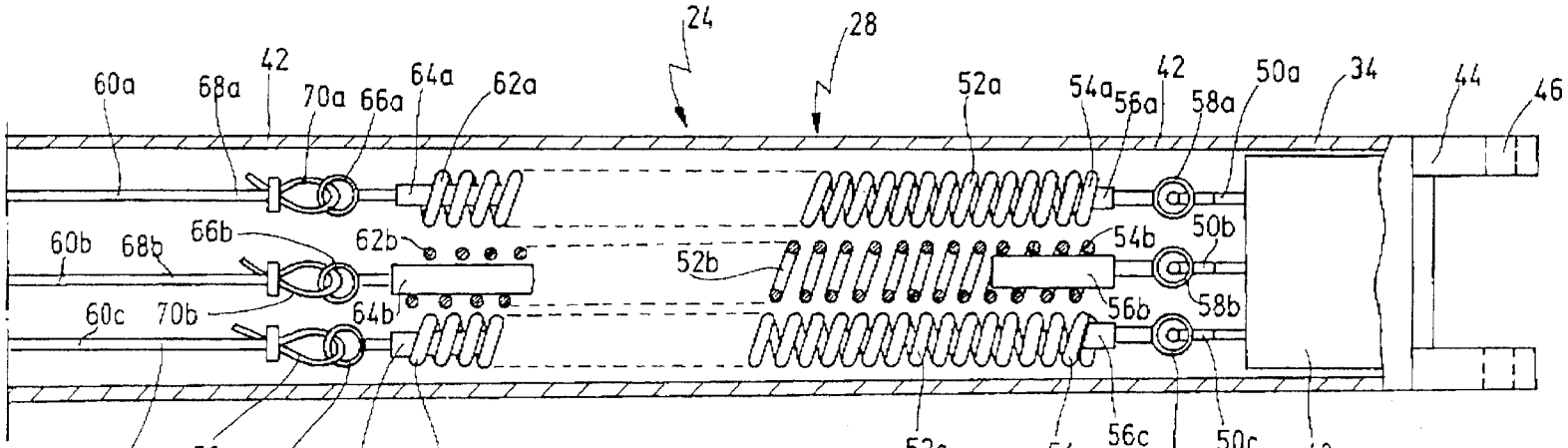
FIGS. 2A and 2B shows an articulated arm according to the invention in two partial pictures, partly in longitudinal section.
Figure 2B:
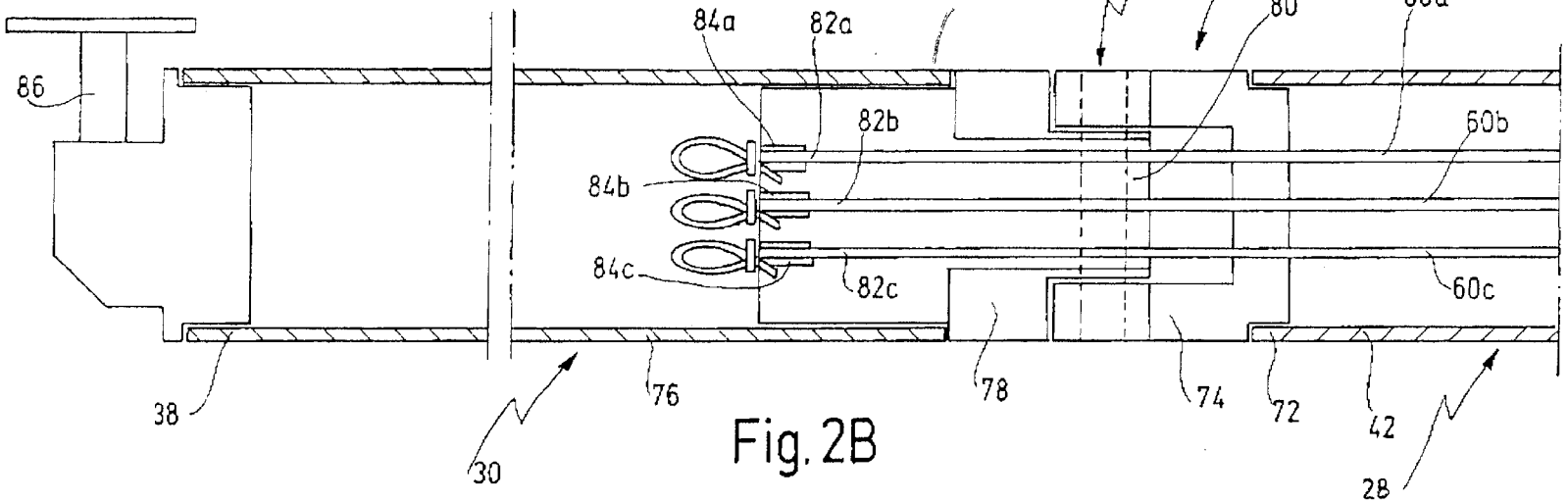

FIGS. 2A and 2B show articulated arm 24 in total in two section, broken views. The right end in FIG. 2B adjoins, correspondingly, to the left end in FIG. 2A. According to FIG. 2A, first arm part 28 is formed by a tubular member 42.

At a first end 34 of first arm part 28, a fork 44 is mounted onto tubular member 42, which is connected with supporting trestle 36 in an articulated way according to FIG. 1. Fork 44 has, through it, a continuous bore 46, through which a pivot pin (not shown) can be put, which produces the articulated connection with supporting trestle 36 in a well understood manner.

Fork 44 also has a block-like extension 48, which encloses end 34 of first arm part 28 and projects partly into tubular member 42. Onto extension 48, in this embodiment, three suspensions 50*a–c* in the shape of crooked hooks are fixed.

In tubular member 42, in this embodiment, three springs 52*a–c* are arranged adjacent to each other. Springs 52*a–c,* in this embodiment, are designed in the shape of coil springs and act as tension springs, i.e. in a force-free state, springs 52*a–c* are pulled together to their maximum and can be stretched by tension in their longitudinal direction. Onto respective first ends 54*a–c* of springs 52*a–c,* an insert nut 56*a–c* is fixed, respectively. Insert nuts 56*a–c* are rolled or pressed onto the respective end 54*a–c* and extend to e.g. some windings into the ends 54*a–d* of springs 52*a–c.* In addition, the insert nuts 56*a–c* in springs 52*a–c* can be welded with the same. In insert nuts 56*a–c,* a respective suspension eyelet 58*a–c,* which are designed in this embodiment as closed ring eyelets, is affixed to. In suspension eyelets 58*a–c,* the respective hook of suspensions 50*a–c* is hooked into.

Each of springs 52*a–c* is, thus, individually fixed onto first arm part 28, more exactly, onto extension 48. Each of springs 52*a–c* is associated with a traction element 60*a–c*. In that way, each traction element 60*a–c* is, individually, firmly connected to a respective second end 62*a–c* of its associated spring 52*a–c*.

In order to fix traction elements 60*a–c* insert nuts 64*a–c* are firmly connected with second ends 62*a–c* respectively. In insert nuts 64*a–c* suspension eyelets 66*a–c* are screwed into, which are designed in the shape of ring eyelets. A respective first end 68*a–c* is respectively laid to a loop 70*a–c,* which grips through the respectively assigned suspension eyelet 66*a–c* and is thus firmly connected to the latter. Loops 70*a–c* are, by means of a squeezing device or a squeezing ring, fixed in an undetachable way. First ends 68*a–c* are still, in first arm part 28, positioned within tubular member 42.

According to FIG. 2B, on first arm part 28 adjacent end 72 of the first arm part 28, again, a fork 74 is firmly connected with tubular member 42. Fork 74 forms a first part of articulation 32, via which first arm part 28 is articulatedly connected with second arm part 30. Second arm part 30 is also formed by a tubular member 76, at a first end 35 of which facing articulation 32, a block 78 is firmly connected with the tubular member 76, wherein block 78 engages with an extension 80 into fork 74. A pivot pin 82 indicated with broken lines passes through fork 74 and extension 80 of block 78.

Traction elements 60*a–c* are led over articulation 32, more exactly, over fork 74, extension 80 of block 78 and block 78 itself into tubular member 76 of second arm part 30. On extension 80 or block 78, traction elements 60*a–c* rest. A respective second end 82*a–c* of traction elements 60*a–c* is respectively individually connected with second arm part 30, for the sake of which a slot 84*a–c* is provided in block 78 for each end 82*a–c,* respectively, in which the respective end 82*a–c* is secured into and, via tubular member 76, is connected with block 78 in such a way that it resists extension. Ends 82*a–c* are in this connection, again, laid into loops, which, by means of a squeezing device or a ring, are secured against detaching.

In an alternative embodiment, instead of fixing ends 82*a–c* individually in block 78, for the sake of which three slots 84*a–c* are provided, it can also be provided to collect ends 82*a–c* to one single end, e.g. by bunching or bundling by means of a squeezing device or a squeezing ring, and then attach this collected end onto block 78, for the sake of which only one of the slots 84*a–c* needs to be there.

On end 38 of second arm part 30, a fixation element 86 is arranged, over which second arm part 30 is connected, articulatedly, with extension bar 40 according to FIG. 1. Traction elements 60*a–c* are flexible, so that they can adjust, in the region of articulation 32, when articulated arm 24 is bent, to the curved transition from first arm part 28 to second arm part 30, and are substantially unextensible, so that they can transmit tensile forces. When articulated arm 24 is bent, springs 52*a–c,* due to the increasing distance length, which overstrain traction elements 60*a–c* in the region of articulation 32, are strained and, thus stressed.

It can be seen from FIGS. 2A and 2B that each traction element 60*a–c* with its corresponding spring 52*a–c* forms an individual force transmitting system which is independent of other traction elements 60*a–c* and other springs 52*a–c*. If there is, for example, a rupture of traction element 60*a*, force transmitting systems from traction elements 60*b*, 60*c* and respective springs 52*b*, 52*c* remain intact, so that articulated arm 24 remains operative, although with reduced tension force.

Traction elements 60*a–c* in this embodiment are designed as wire cables, which have, at least in the region of articulation 32, in which traction elements 60*a–c* rest upon extension 80 of block 78, a plastic coat. Friction of traction elements 60*a–c* on extension 80 is thereby reduced.

In the embodiment shown, each spring 52*a–c* is assigned with a traction element 60*a–c*. It can also be provided to assign to each spring 52*a–c* two or more traction elements 60*a–c*, whereby each force transmitting system formed in that way is designed independently from the other force transmitting systems.

While the embodiment shown has three springs 52*a–c*, it is also possible, in the scope of the invention, to provide an articulated arm with two springs or four or more springs. In the scope of the invention, it is also possible to connect ends 62*a–c* of springs 52*a–c* with each other, whereby a brace used for it has suspensions in corresponding number, in order to be able to suspend these individually. It will also be appreciated that additional articulated arms 24, 26 can be included for an awning 10 of greater width.

Although the foregoing description of the preferred embodiment of the present invention has shown, described, and pointed out the fundamental novel features of the invention, it will be understood that various omissions, substitutions, and changes in the form of the detail of the apparatus as illustrated as well as the uses thereof, may be made by those skilled in the art without departing from the spirit of the present invention. Consequently, the scope of the present invention should not be limited to the foregoing discussions, but should be defined by the appended claims.

What is claimed is:

1. An articulated arm for an awning comprising:

a first arm part and at least a second arm part each arm part having a longitudinal axis;

an articulation having an articulation axis wherein the first arm part and the at least second arm part are connected to each other via the articulation and wherein the articulation axis extends transversely to at least one of the longitudinal axes of the arm parts;

at least two springs arranged adjacent each other, each of the springs having a first end and a second end, the first ends being fixed to the first arm part; and at least two traction elements each having a first end and a second end, the first ends of the traction elements being respective connected to the second ends of the springs and the traction elements being led via the articulation to the second arm part and fixed thereto, wherein at least one traction element is associated with a corresponding spring and wherein the traction elements comprise wire cables with a plastic coat in at least in a region of the wire cables adjacent the articulation.

2. The articulated arm of claim 1, wherein the second end of each traction element assigned to the corresponding spring is fixed individually on the second arm part.

3. The articulated arm of claim 1, wherein the springs comprise coil springs and wherein an insert nut is fixed on at least one end of the springs and into which end a suspension eyelet is affixed.

4. The articulated arm of claim 3, wherein the insert nut is rolled onto the spring.

5. The articulated arm of claim 3, wherein the insert nut is pressed onto the spring.

6. The articulated arm of claim 1, wherein at least two traction elements are associated with each spring.

7. An awning comprising an articulated arm, the arm comprising:

a first arm part and at least a second arm part each arm part having a longitudinal axis;

an articulation having an articulation axis wherein the first arm part and the at least second arm part are connected to each other via the articulation and wherein the articulation axis extends transversely to at least one of the longitudinal axes of the arm parts;

at least two springs arranged adjacent each other wherein each of the springs has a first end and a second end, the first ends of the springs being fixed at the first arm part; and at least two traction elements each having a first end and a second end the first ends of the traction elements being respective connected to the second ends of the springs and the traction elements being led via the articulation to the second arm part and fixed thereto, wherein at least one traction element is associated with each spring and wherein the traction elements comprise wire cables with a plastic coat in at least a region adjacent the articulation.

8. An articulated arm for an awning comprising:

a first arm part and at least a second arm part each arm part having a longitudinal axis;

an articulation having an articulation axis wherein the first arm part and the at least second arm part are connected to each other via the articulation and wherein the articulation axis extends transversely to at least one of the longitudinal axes of the arm parts;

at least two coil springs arranged adjacent each other, each of the springs having a first end and a second end, the first ends being fixed to the first arm part;

an insert nut fixed onto at least one end of the springs and into which end a suspension eyelet is affixed; and at least two traction elements each having a first end and a second end, the first ends of the traction elements being individually connected to the second ends of the springs and the traction elements being led via the articulation to the second arm part and fixed thereto, wherein at least one traction element is associated with a corresponding spring and wherein the traction elements comprise wire cables with a plastic coating at least in a region of the wire cables adjacent the articulation.

9. The articulated arm of claim 8, wherein the insert nut is rolled onto the spring.

10. The articulated arm of claim 8, wherein the insert nut is pressed onto the spring.

* * * * *